US005777564A

United States Patent [19]

Jones

[11] Patent Number: 5,777,564

[45] Date of Patent: Jul. 7, 1998

[54] TRAFFIC SIGNAL SYSTEM AND METHOD

[76] Inventor: Edward L. Jones, P.O. Box 329287, Cocoa Beach, Fla. 32932

[21] Appl. No.: 659,275

[22] Filed: Jun. 6, 1996

[51] Int. Cl.[6] ..... G08G 1/017

[52] U.S. Cl. ..... 340/917; 340/933; 340/907; 340/937; 364/436

[58] Field of Search ..... 340/909, 917, 340/919, 920, 923, 926, 929, 910, 922, 933, 937, 935; 364/436, 437

[56] References Cited

U.S. PATENT DOCUMENTS

| | | | |
|---|---|---|---|
| 3,503,041 | 3/1970 | Du Vivier | 340/920 |
| 3,582,876 | 6/1971 | Carmack | 340/920 |
| 3,613,074 | 10/1971 | Moline et al. | 340/919 |
| 4,215,405 | 7/1980 | Brunner et al. | 364/436 |
| 4,370,718 | 1/1983 | Chasek | 364/436 |
| 4,449,116 | 5/1984 | Hill et al. | 340/909 |
| 4,590,455 | 5/1986 | Frizinger | 340/907 |
| 4,908,616 | 3/1990 | Walker | 340/920 |
| 5,278,554 | 1/1994 | Marton | 340/910 |
| 5,283,573 | 2/1994 | Takatou et al. | 340/937 |
| 5,296,852 | 3/1994 | Rathi | 340/933 |
| 5,523,753 | 6/1996 | Fedde et al. | 340/933 |
| 5,530,441 | 6/1996 | Takatou et al. | 340/933 |

*Primary Examiner*—Brent A. Swarthout
*Assistant Examiner*—Van T. Trieu
*Attorney, Agent, or Firm*—Conley, Rose & Tayon

[57] ABSTRACT

System and method for the improved operation of a traffic signal system which reduces delays to vehicular traffic at one or more signalized intersections by detecting vehicular demand for movement through each intersection. The present invention uses detectors for detecting vehicles entering an intersection, at a distance sufficiently great from the intersection, and for detecting vehicles leaving an intersection, at a distance sufficiently near to the intersection, to permit, when possible, one or more vehicles to proceed completely through the intersection prior to coming to a near, or complete stop. The system and method further facilitates accident reduction by monitoring portions of traffic lanes entering an intersection for vehicles, determining the probability of a vehicle being able to timely stop for a halt signal, and, if it is determined that the vehicle cannot timely stop for a halt signal, attempting to clear the intersection of other vehicles by setting all signals to halt.

22 Claims, 9 Drawing Sheets

New Field of Detection

Typical Traffic Movements

Current Field of Detection

Current Field of Detection

New Field of Detection

Preferred Embodiment of System for Controlling Movement of Vehicles Through an Intersection

TRAFFIC SIGNAL SYSTEM AND METHOD

FIELD OF THE INVENTION

The present invention relates to a system and method for the improved operation of a traffic signal system which reduces delays to vehicular traffic at one or more signalized intersections by detecting a vehicle's demand for movement through each intersection, and, when possible, permitting the vehicle to proceed through one or more intersections, prior to the vehicle coming to a near, or complete, stop and/or which facilitates accident reduction by monitoring portions of traffic lanes entering an intersection for vehicles, determining the probability of a vehicle being able to timely stop for a halt signal, and, if necessary, attempting to clear the intersection of other vehicles.

DESCRIPTION OF THE RELATED ART

Traffic signals are commonly used to control and facilitate the orderly progression of vehicles through intersections. Early traffic signals were operated by traffic officers using manual switches to activate signal displays at intersections. To automate these signals and improve intersection efficiency, controller units for controlling the traffic signals were developed and implemented. The basic function of these early controller units was to alternately assign the right-of-way between two or more traffic lanes with conflicting traffic movements.

These early controller units were electromechanical pre-timed devices, using motors and gears for timing, that could change the signal displays. These early controllers, however, were not easily adjustable and repeated cycle after cycle for each lane of traffic on one or more pre-set timing plans, without regard to actual vehicle demand. Although the cycle timing could be adjusted to accommodate the needs of periodic heavy movement, such as morning and evening peaks, these controllers could not cope with, nor could they provide flexibility for, the changes in traffic flow that occurred throughout the day. This inflexibility often meant that a signal was showing stop for vehicles in a traffic lane that needed to proceed through the intersection, and vice versa.

The development of traffic actuated controller units provided some flexibility for accommodating varied traffic flow. These actuated traffic controller units permitted cycle timing to be varied for some or all controlled conflicting traffic lanes (i.e., lanes of traffic that would have interfering vehicle movements through the intersection if allowed to operate concurrently) depending upon vehicular demand by utilizing detectors placed in or near the intersection and the relevant portions of the traffic lanes entering into the intersection. Early traffic actuated controller units were of a sonic type. Located at the stop lines of an intersection, these detectors were responsive to a motorist blowing the vehicle's horn. Upon actuation, these controllers permitted the motorist to obtain the right-of-way. These early actuated controller units were essentially, however, modified pre-timed controller units which provided only a fixed length cycle upon actuation.

To improve intersection efficiency, control units were developed that could flexibly extend a cycle, within certain parameters, based upon vehicular demand. Detection units progressed from the early sonic type to pressure sensitive devices and electrical circuits that were embedded in the roadway and actuated by the weight of a passing vehicle or a change of inductance during passage of a vehicle. In addition to the above detection devices, current controller units utilize various detection methods, including sonar, radar, infrared, photo-electric cell, and magnetic devices for detecting vehicles in the portion of traffic lanes entering an intersection.

Although intersection efficiency has increased as a result of the technological progression in detection devices, current traffic signal systems continue to operate on a cycle by cycle basis for an intersection; each cycle consisting of one more progression phases for certain traffic lanes (i.e., proceed signals for permitting movement of certain traffic lanes through the intersection) and non-progression phases for the remaining traffic lanes (i.e., caution and halt signals for halting movement of the remaining traffic lanes through the intersection). FIG. 1 depicts typical traffic movements through intersection 100.

The introduction of microprocessors to controllers brought about major changes in traffic signal systems, including the ability to coordinate the movement of traffic through two or more signalized intersections. Coordination of two or more signalized intersections resulted in a number of benefits, including the ability to change timing plans to accommodate predominate traffic flows; to increase capacities of major arterials to meet peek demands; to control speeds on major arterials; and to conserve energy and improve safety by reducing stops and delays. Coordination among two or more intersections is typically accomplished by either a centralized controller system (i.e., a central controller performing all processing functions for each of the intersections) or a distributed controller system (i.e., two or more controllers responsible for controlling the signalized intersections assigned to such controllers and for further communicating between one another). Communications in a coordinated system are typically conducted through twisted pair cable, coaxial cable, fiberoptic cable, or radio transmission. The operation of current traffic controllers and the coordination of two or more signalized intersections is well known in the current art and the reader is directed to the publication entitled "Participant Notebook" dated Jul. 1993 for Traffic Control Equipment & Software Demonstration Project, published by the United States Department of Transportation, Federal Highway Administration, for a more thorough discussion of current traffic controllers and the coordination of signalized intersections.

As can be seen in FIGS. 2*a* and 2*b*, the current art employs zones for detecting vehicles 225, 230, 235, 240, 245, 250, 255, and 260 entering intersection 200. Detection zones 245, 250, 255, and 260 typically include loop detectors (i.e., a detector that senses change in inductance of its inductive loop sensor caused by the passage or presence of a vehicle near the sensor), presence detectors (i.e., a detector which is able to detect the presence of a vehicle and maintain the detection signal for a predetermined period of time that the vehicle is within its field of detection), or a combination of loop and presence detectors. Detection zones 225, 230, 235, 240, 245, 250, 255, and 260 are limited to areas which are in close proximity to stop lines 205, 210, 215, and 220 for each traffic lane. This relatively close proximity of such detection zones to such stop lines requires vehicles approaching such an intersection in a traffic lane with a caution or halt signal showing to come to a near, or complete, stop before each vehicle's demand for a proceed signal is recognized and serviced by the controller for the intersection. Thus, the orderly progression of vehicles through such an intersection is often halted or delayed because a vehicle is required to wait for a proceed signal, although no demand for a proceed signal exists by vehicles in one or more conflicting traffic lanes. Also, current traffic signal systems do not monitor the portions of traffic lanes leaving the intersection to determine if the leaving portions are not blocked (i.e., free of vehicles) so that complete movement of vehicles through the intersection is possible.

A further limitation of the close proximity of the detection zones to the intersection is that current controllers and methods for operating a signalized intersection do not generally provide accident avoidance functions. That is, current controllers and methods for operating a signalized intersection do not monitor the portions of traffic lanes entering an intersection to determine the probability of a vehicle being able to pass through the intersection during a caution signal or to timely stop for a halt signal, nor do they attempt to clear the intersection, so as to prevent a possible accident if it is determined that a vehicle will not be able to pass through the intersection during a caution signal or to timely stop for a halt signal.

Therefore, a system and method is desired for controlling one or more signalized intersections in which delays to vehicular traffic are reduced by detecting the presence of a vehicle, determining if the vehicle can proceed completely through an intersection, and when possible, providing a proceed signal for the vehicle before the vehicle has come to a near, or complete, stop. A system and method is also desired which facilitates accident reduction by monitoring the probability of a vehicle being able to pass through an intersection or to timely stop for a caution or halt signal, respectively, and attempts to clear the intersection when it becomes likely that a vehicle will not be able to pass through the intersection or to timely stop for a caution or a halt signal, respectively.

SUMMARY OF THE INVENTION

The present invention includes a system and method for reducing delays to vehicular traffic through one or more signalized intersections and for facilitating accident reduction at such intersections. The present invention comprises detectors, such as a camera system, for detecting vehicles entering and leaving an intersection, a plurality of signals for controlling the movement of vehicles through the intersection, and at least one controller for controlling the plurality of traffic signals at one or more signalized intersections. The present invention may operate in either a centralized system or a distributed system. The present invention monitors the portions of traffic lanes entering and leaving each intersection for vehicles and generates signals that correspond to whether the detected vehicles are entering or leaving each intersection. The controller receives these signals and, preferably using the method of the present invention, controls the plurality of traffic signals to permit the efficient movement of traffic through each intersection and to facilitate accident reduction at each intersection.

The system monitors detection zones for portions of traffic lanes entering each intersection that comprise areas whose outer boundaries are at a distance from each stop line for each intersection. This permits detection of vehicles at a greater distance from each stop line than is conducted by the current art. Unlike the current art, the system also preferably monitors detection zones for portions of traffic lanes leaving each intersection to determine whether a vehicle is substantially proximate to the intersection, and thus, determine if there is sufficient room in the applicable traffic lane for another vehicle to proceed through and clear (i.e., not be present in) the intersection.

Further, the detection zones for portions of traffic lanes entering each intersection are sufficiently distant from each stop line to permit, when possible, the controller to process the detection signals and cause the display of a halt signal on the applicable traffic signals for all conflicting lanes of traffic entering the intersection and a proceed signal for the applicable lane of traffic entering the intersection upon the detection of a vehicle. Thus, the detected vehicle will not be required to come to a near, or complete, stop before receiving a proceed signal. The length of the detection zones for portions of traffic lanes entering the intersection also permit the controller to process the detection signals, and when vehicles are proceeding through the intersection, determine if a vehicle approaching the intersection in a traffic lane which conflicts with the traffic lane(s) for those vehicles proceeding through the intersection is capable of stopping before reaching the intersection. If a determination is made that the vehicle cannot stop before reaching the intersection, the system generates halt signals to all signals in an effort to facilitate accident reduction by clearing the intersection.

BRIEF DESCRIPTION OF THE DRAWINGS

A better understanding of the present invention can be obtained when the following detailed description of the preferred embodiment is considered in conjunction with the following drawings in which.

DETAILED DESCRIPTION OF THE PREFERRED EMBODIMENTS

Figure 1:
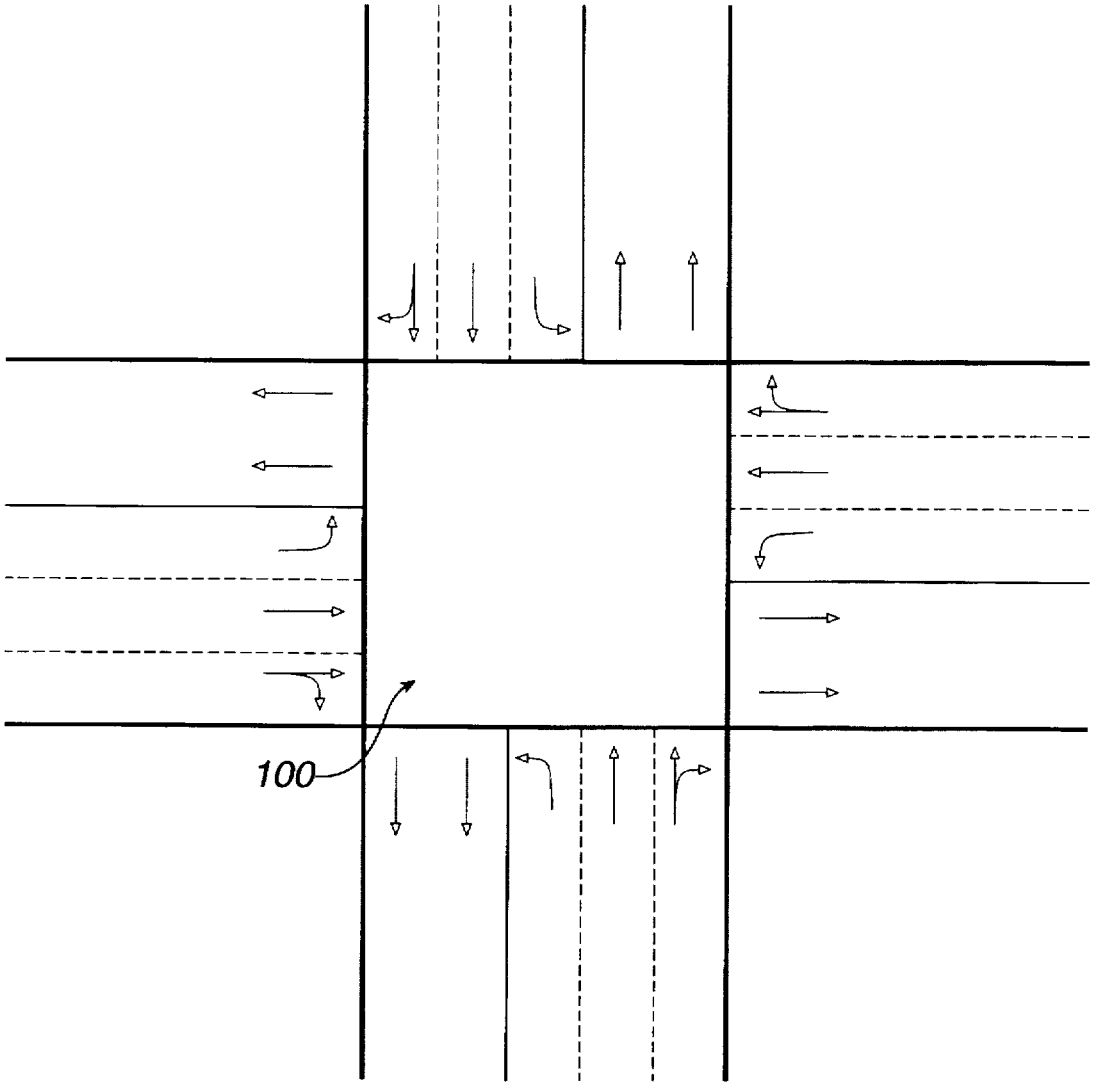
FIG. 1 depicts typical traffic movements at an ordinary intersection.
Figure 2A:
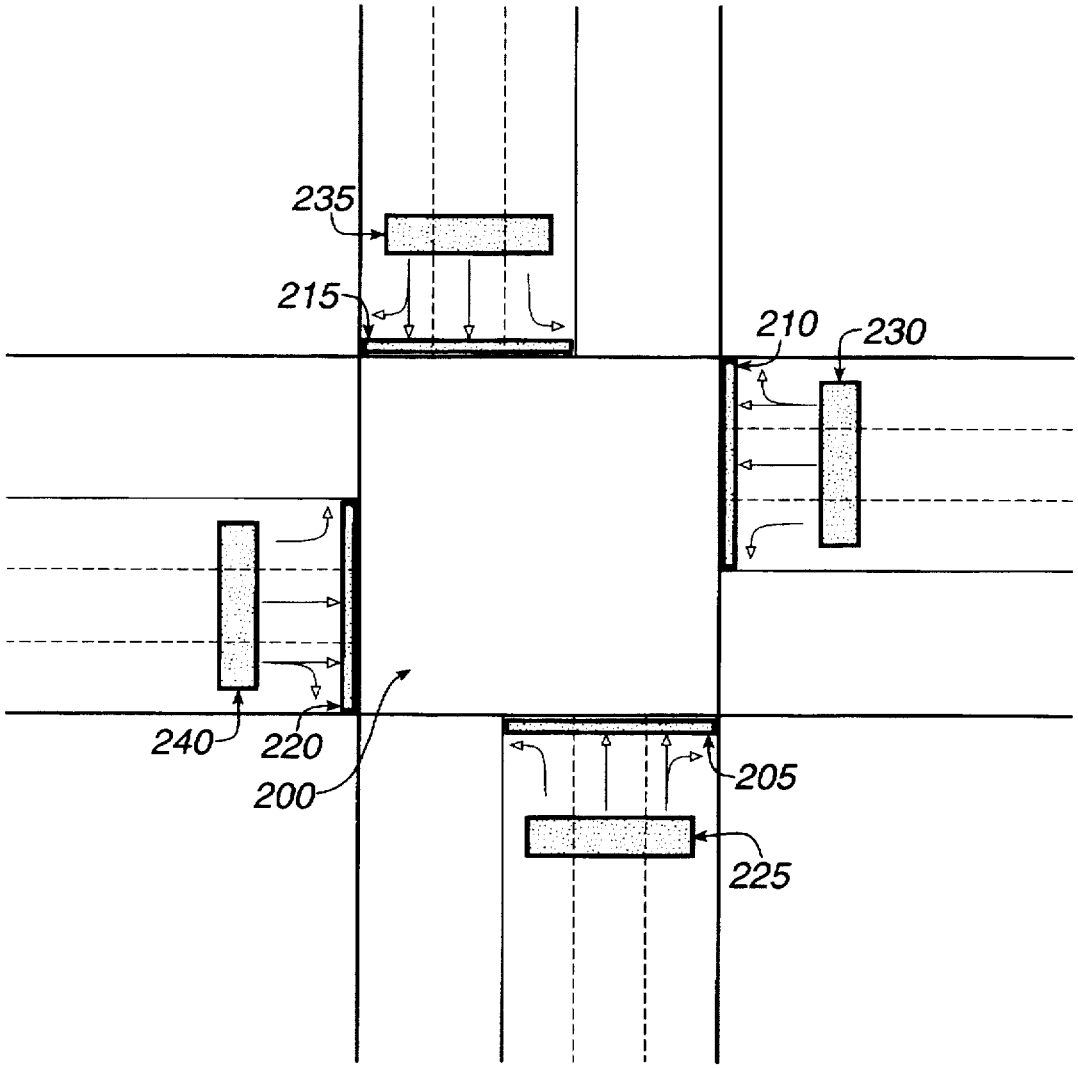
FIGS. 2*a* and 2*b* depict zones of detection employed by the current art for detecting vehicles in portions of traffic lanes entering an intersection.
Figure 2B:
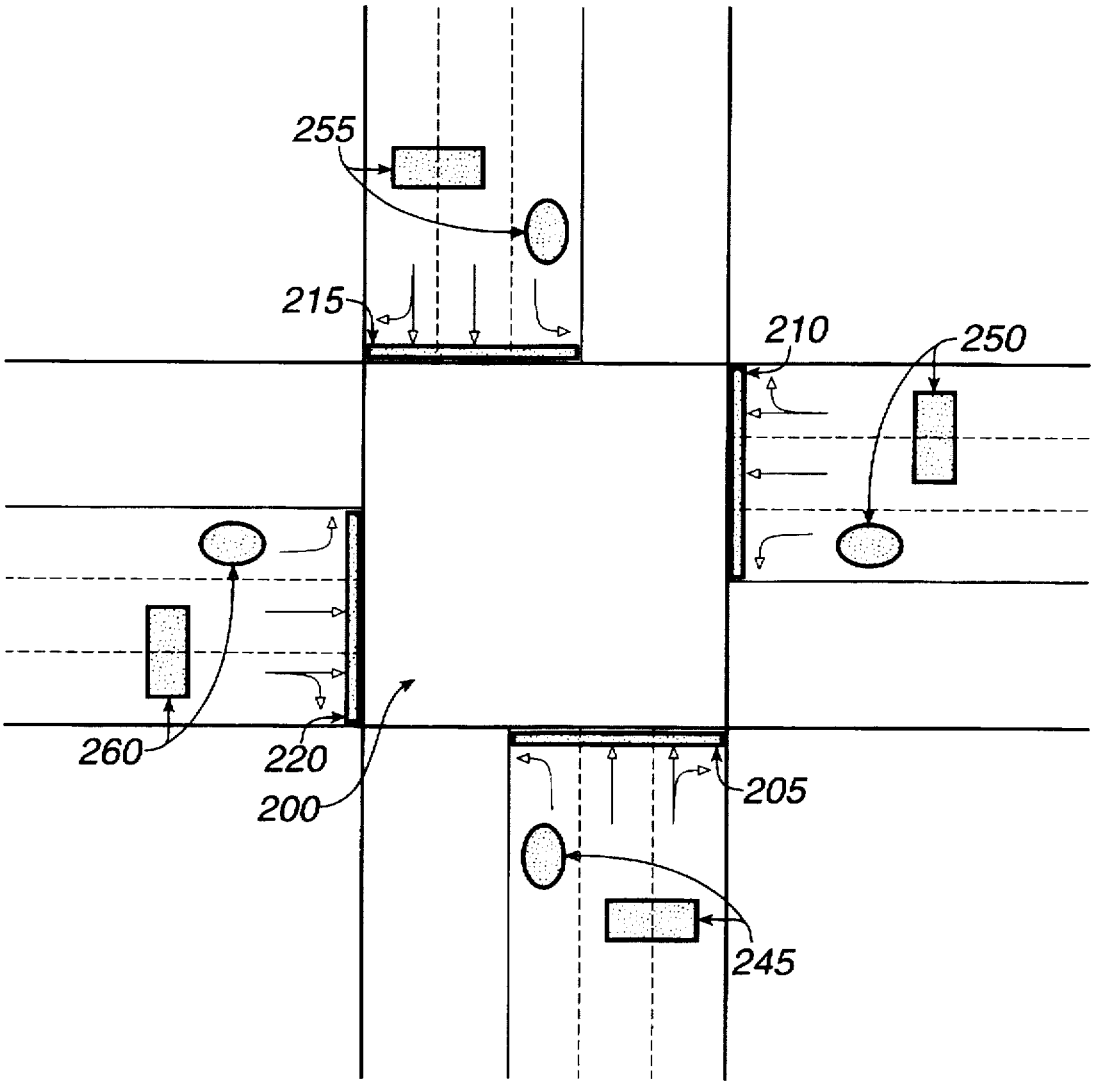
Figure 3:
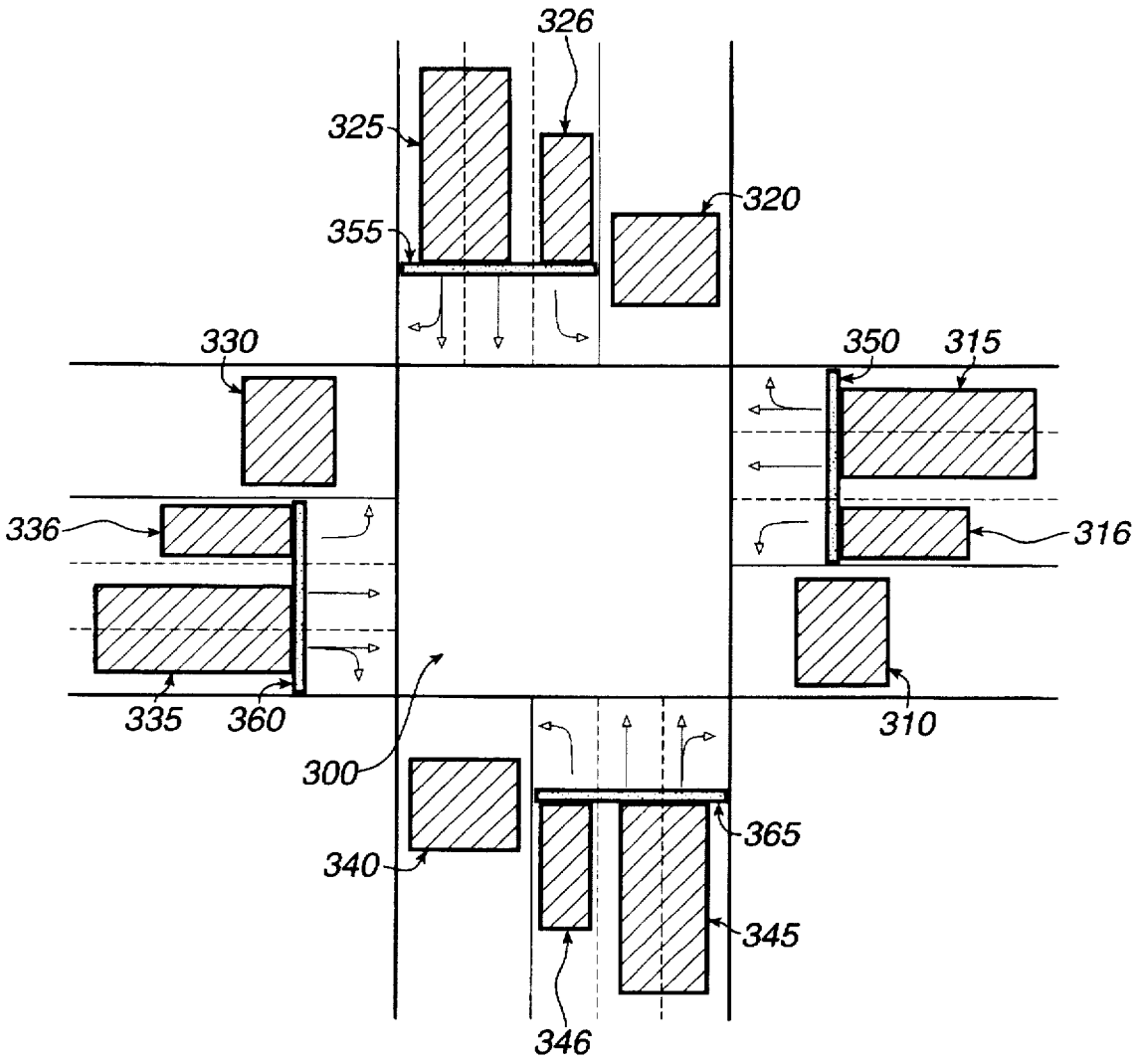
FIG. 3 depicts the zones of detection employed by the present invention for detecting vehicles in portions of traffic lanes entering and leaving an intersection.

Turning to FIG. 3, a preferred embodiment of the invention for controlling movement of vehicles at an intersection includes detection zones 315, 316, 325, 326, 335, 336, 345, and 346 for detecting vehicles entering intersection 300 and detection zones 310, 320, 330, and 340 for detecting vehicles leaving intersection 300. It should be noted that detection zones 315, 316, 325, 326, 335, 336, 345, and 346 comprise areas whose outer boundaries are at a distance from stop lines 350, 355, 360, and 365, respectively, so as to permit detection of vehicles at a greater distance from stop lines 350, 355, 360, and 365, respectively, than is monitored by the current art (See 225, 230, 235, 240, 245, 250, 255, and 260 of FIGS. 2*a* and 2*b*).

The distance from stop lines 350, 355, 360, and 365 for detection zones 315, 316, 325, 326, 335, 336, 345, and 346 is sufficiently great to permit, when possible, the display of a halt signal for all conflicting lanes of traffic and a proceed signal for the applicable lane of traffic upon the detection of a vehicle within applicable detection zone 315, 316, 325, 326, 335, 336, 345, and 346 so that the detected vehicle will not be required to come to a near, or complete, stop before receiving a proceed signal. It should be noted that detection zones 316, 326, 336, and 346 will typically be of a shorter distance from stop lines 350, 355, 360, and 365 then detection zones 315, 325, 335, and 345 because such detection zones are for left turning traffic lanes. The preferred embodiment of the invention includes separate detectors for monitoring left turning traffic lanes. In other embodiments of the invention, the system does not include such separate detectors for monitoring left turning traffic lanes, but rather, includes a single detector. It should also be noted that detection zones 310, 320, 330, and 340 leaving intersection 300 are smaller than detection zones 315, 316, 325, 326, 335, 336, 345, and 346 and are sufficiently large to detect a vehicle that is substantially proximate to intersection 300 so that there is insufficient room in the applicable traffic lane for another vehicle to proceed through and clear (i.e., not be present in) intersection 300.

Figure 4:
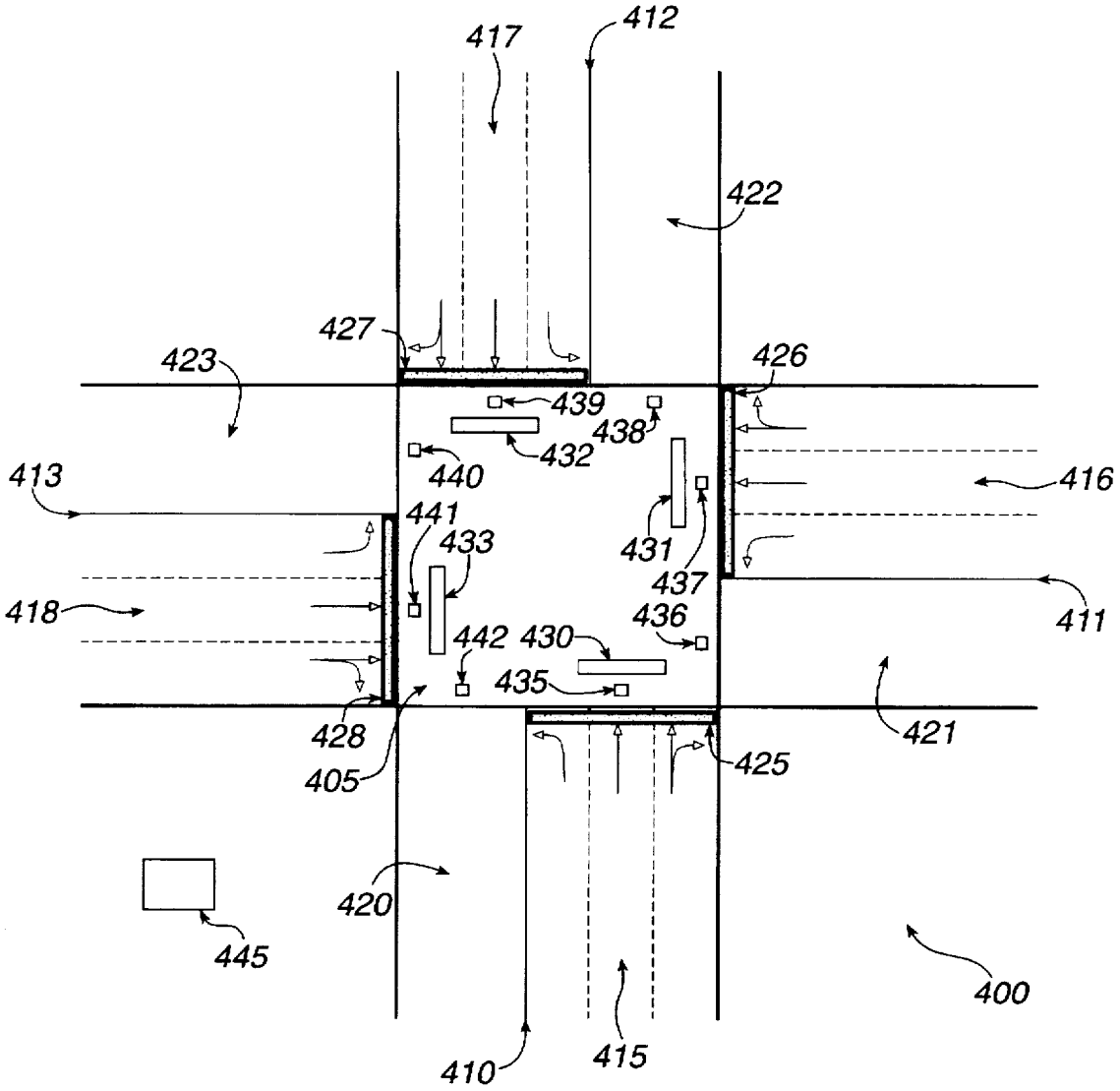
FIG. 4 depicts a system configuration for one embodiment of the present invention.

As shown in FIG. 4, a preferred embodiment of system 400 for controlling movement of vehicles through intersection 405 having a plurality of traffic lanes 410, 411, 412, and 413 (wherein each of the traffic lanes 410, 411, 412, and 413 includes a portion entering 415, 416, 417, and 418 intersection 405, a portion leaving 420, 421, 422, and 423 intersection 405, and a stop line 425, 426, 427, and 428 located in entering portions 415, 416, 417, and 418) includes a plurality of traffic signals 430, 431, 432, and 433 corresponding to each entering portion 415, 416, 417, and 418 of traffic lanes 410, 411, 412, and 413; a plurality of detection devices 435, 436, 437, 438, 439, 440, 441, and 442 for detecting the presence of vehicles in detection zones entering and leaving intersection 405 (See 310, 315, 316, 320, 325, 326, 330, 335, 336, 340, 345, and 346 of FIG. 3) wherein detection devices 435, 436, 437, 438, 439, 440, 441, and 442 are configured to generate a demand signal or a halt signal corresponding to the applicable traffic lane in which the vehicle is detected for entering portions 415, 416, 417, and 418 or leaving portions 420, 421, 422, and 423, respectively, of applicable traffic lane 410, 411, 412, and 413 in which the vehicle was detected; and controller 445 for receiving and processing the demand and halt signals from detection devices 435, 436, 437, 438, 439, 440, 441, and 442 and controlling traffic signals 430, 431, 432, and 433 to permit the movement of vehicles through intersection 405.

It should be noted that detection devices 435, 437, 439, and 441 may include separate detection devices for monitoring one or more individual traffic lanes of entering portions 415, 416, 417, and 418 and leaving portions 420, 421, 422, and 423. It should be further noted that traffic signals 430, 431, 432, and 433 may include separate signals for controlling the movement of traffic in one or more individual traffic lanes of entering portions 415, 416, 417, and 418. One embodiment of detection devices 435, 436, 437, 438, 439, 440, 441, and 442 preferably includes a camera system as disclosed in U.S. Pat. No. 5,438,360 titled Machine Vision Camera and Video Preprocessing System. Other embodiments of detection devices 435, 436, 437, 438, 439, 440, 441, and 442 may include sonar, radar, infrared, and/or magnetic detection means. One embodiment of controller 445 preferably includes the 3000 Series Advanced Nema Traffic Controller manufactured by Peek Traffic-Transyt of Tallahassee, Fla.

Figure 5:
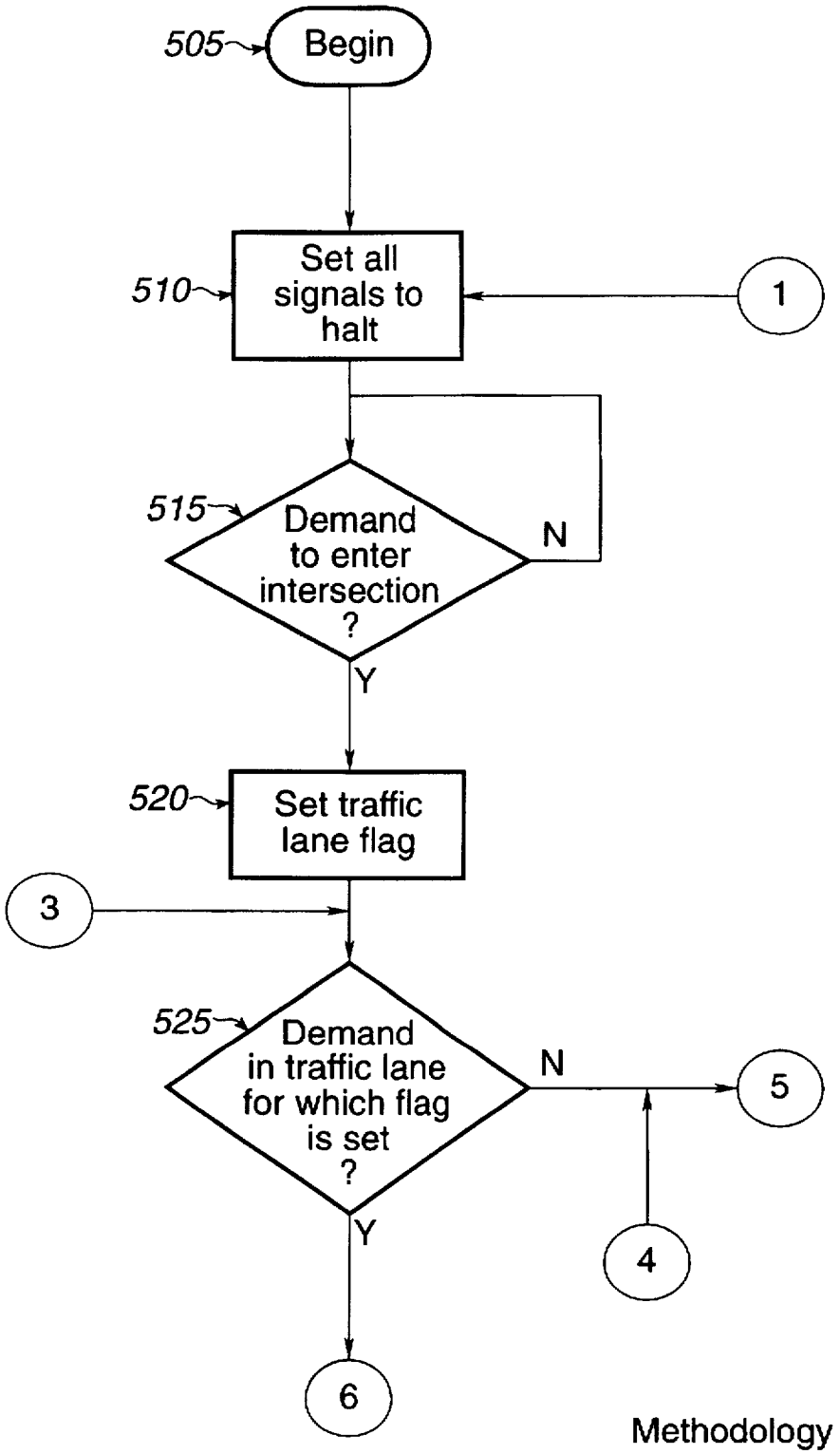
FIG. 5 depicts a flow chart of the methodology for the present invention.
Figure 5:
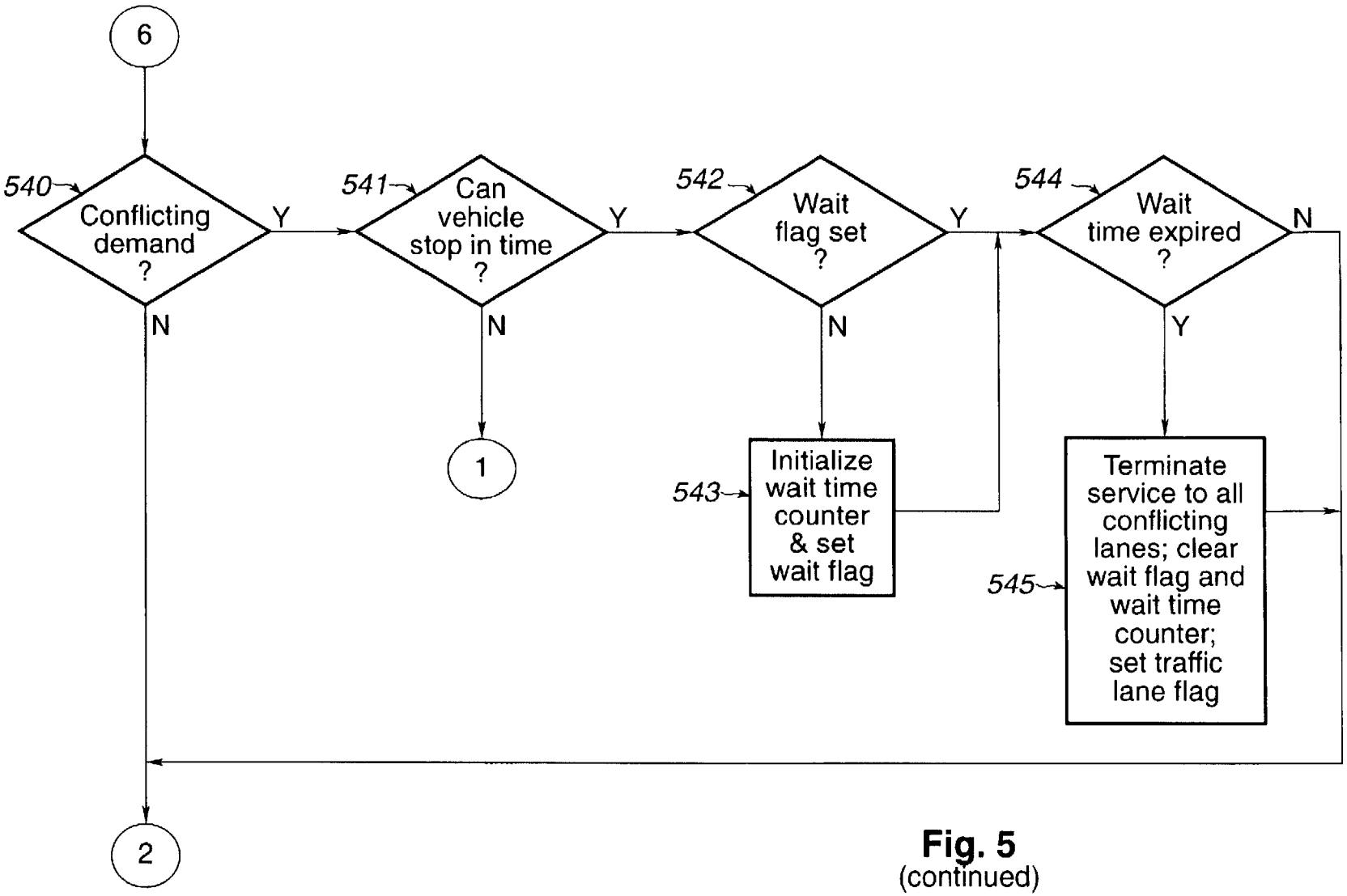
Figure 5:
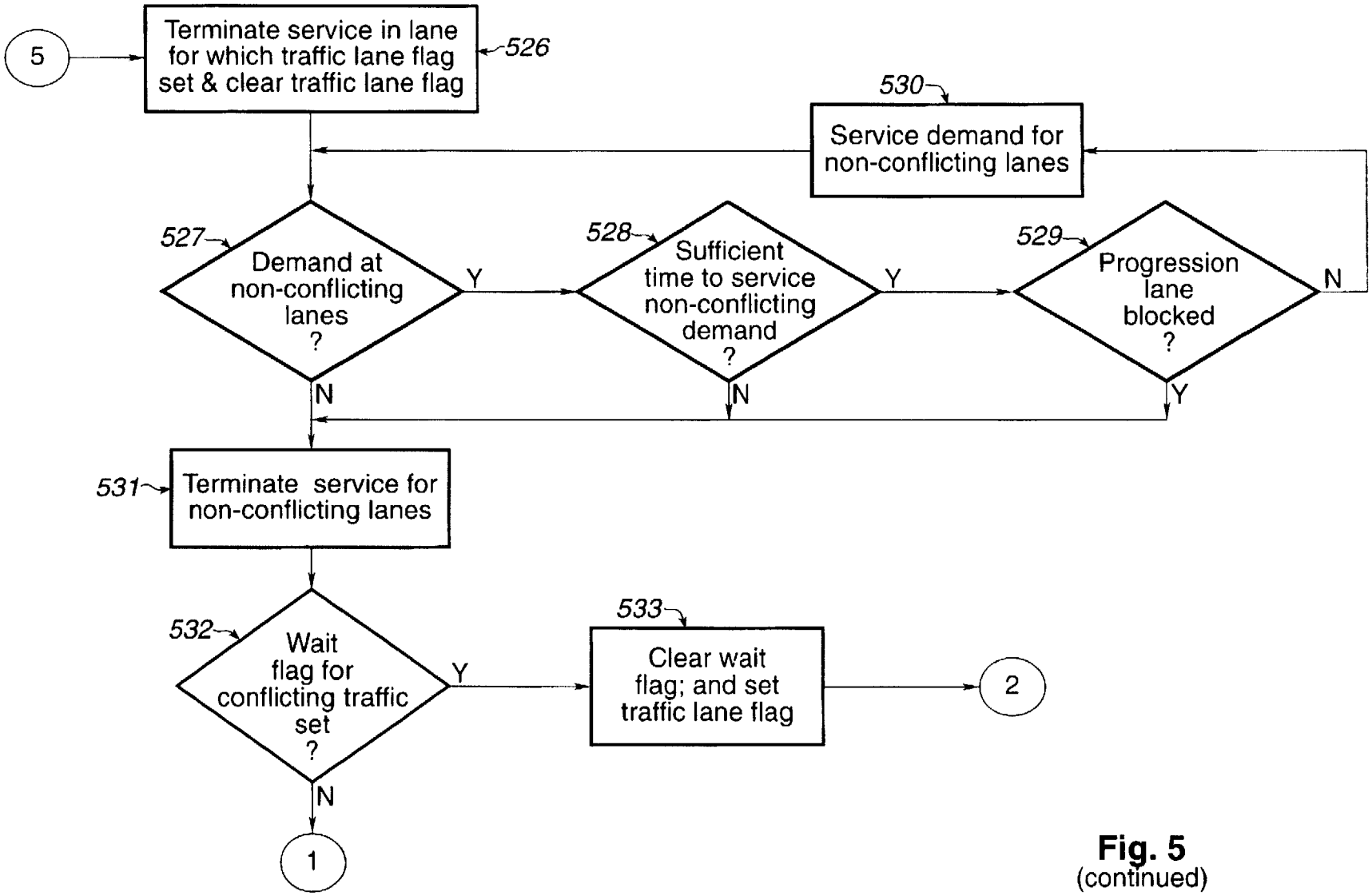
Figure 5:
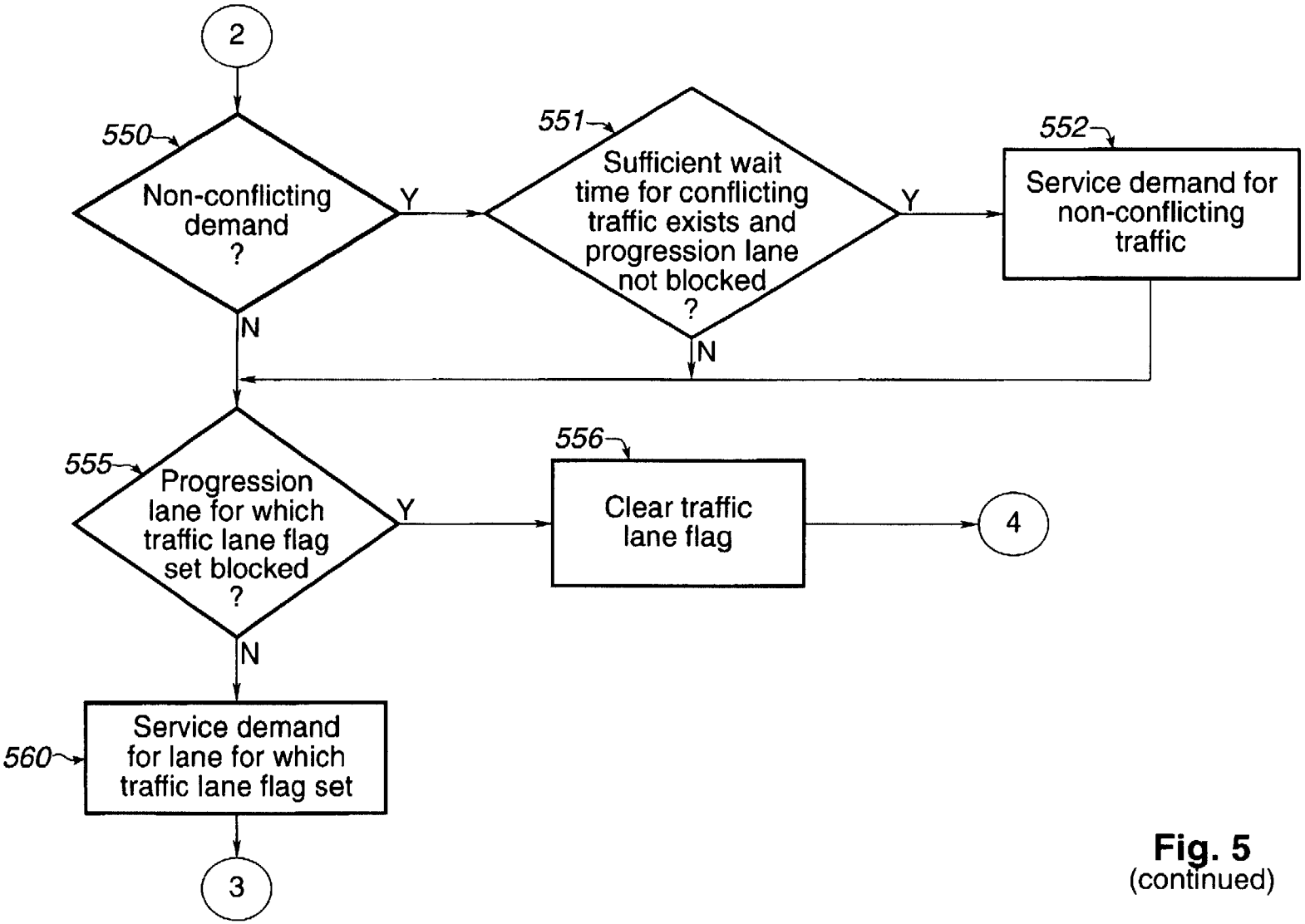

FIG. 5 depicts the overview of the methodology for controlling traffic signals 430, 431, 432, and 433 (See FIG. 4). The methodology begins 505 with setting all traffic signals to a halt indication 510.

If demand to enter the intersection is detected 515, a traffic lane flag is set which indicates the traffic lane in which the demand was detected 520. If demand for the traffic lane for which the traffic lane flag is set exists 525, a check for a conflicting demand to enter the intersection is conducted 540.

Steps 540, 541, 542, 543, 544, and 545 relate to handling conflicting demand to enter the intersection if such demand exists and comprise the following. First, a determination is made as to whether the detected vehicle with the conflicting demand is traveling at a rate of speed that will permit the vehicle to stop before arriving at the applicable stop line for the intersection 541. If not, all signals are set to halt in an effort to clear the intersection 510 and, thereby, facilitate accident reduction. If it is determined that the vehicle can stop before arriving at the applicable stop line, a determination is made as to whether a wait flag (i.e., an indication that conflicting traffic has been waiting to proceed through the intersection) has been set 542. If the wait flag has not been set, a counter for the period of time that conflicting traffic must wait before being allowed to proceed through the intersection is initialized and the wait flag is set 543. Step 543 is avoided if the wait flag was previously set. Next a determination is made as to whether the maximum amount of time that conflicting traffic must wait before being allowed to proceed through the intersection has transpired 544. If the wait time has not transpired, the demand signal generated by the conflicting traffic is ignored 544. If the wait time has transpired, then caution and halt signals, respectively, are displayed for traffic lanes associated with the traffic lane flag and the wait flag for conflicting traffic is cleared 545.

After determining if conflicting demand to enter the intersection exists 525 and servicing such demand if it does exist 541, 542, 543, 544, and 545, a determination is made as to whether non-conflicting demand to enter the intersection (i.e., demand from vehicles that would not interfere with the current demand if such vehicles were permitted to proceed through the intersection concurrently with the existing demand) exists 550. If such non-conflicting demand exists and if a predetermined amount of time remains before the wait time for conflicting demand (which was initialized in 543) transpires and if the portion of the applicable traffic lane leaving the intersection for the non-conflicting demand is not blocked (i.e., no vehicles are present in the applicable detection zone so as to prevent another vehicle from proceeding through and out of the intersection) 551, a proceed signal is displayed for those traffic lanes associated with the non-conflicting demand 552.

After determining if non-conflicting demand to enter the intersection exists 550 and handling such demand if it does exist 551 and 552, a determination is made as to whether the portion of the traffic lane associated with the traffic lane flag leaving the intersection is blocked 555. If the leaving portion of the traffic lane is blocked, the traffic lane flag is cleared 556 and a transfer to 526, which is discussed in detail below, is made. If the leaving portion of the traffic lane is not blocked, a proceed signal is displayed for the traffic lane 560 and a determination is once again made as to whether demand for the traffic lane for which the traffic lane flag is set exists 525.

If demand for the traffic lane for which the traffic lane flag is set does not exist 525, service associated with the traffic lane is terminated (i.e., caution and halt signals are displayed), and the traffic lane flag is cleared 526. A determination is then made as to whether non-conflicting demand to enter the intersection exists 527. If non-conflicting demand to enter the intersection does exist, it is allowed to enter the intersection 530 if sufficient time exists before conflicting demand must be serviced and if the progression lane(s) for such non-conflicting demand are not blocked 529. Service for non-conflicting demand to enter the intersection is terminated 531 when such demand no longer exists, if insufficient time exists before conflicting demand must be serviced, or if the progression lane(s) for such non-conflicting demand are blocked 529. A determination is then made as to whether conflicting traffic is waiting to enter the intersection 532, if so the wait flag is cleared, the traffic lane flag is set 533 and a transfer to determining whether non-conflicting demand exists is made 550. If there is no conflicting traffic waiting to enter the intersection, all signals are set to halt 510.

While the invention has been described in detail with reference to specific embodiments thereof, it will be apparent to one skilled in the art the various changes and modifications can be made therein without departing from the spirit and scope thereof.

What is claimed is:

1. A system for controlling movement of vehicles at one or more intersections, wherein each of said one or more intersections includes a plurality of traffic lanes, wherein each of said plurality of traffic lanes includes an entering portion, a leaving portion, and a stop the located between each of said one or more intersections and each of said entering portions for each of said plurality of traffic lanes, comprising:

a plurality of detectors for monitoring one or more of said entering portions and one or more of said leaving portions of said plurality of traffic lanes, at least one of said plurality of detectors being adapted to monitor a section of one of said entering portions located outside of an immediate vicinity of the corresponding intersection, and wherein said plurality of detectors detect each incident of presence of one or more vehicles within one or more of said entering portions and one or more of said leaving portions of said plurality of traffic lanes and upon each said detection incident of one or more vehicles in said entering portions of said plurality of traffic lanes generate one or more demand signals corresponding to said entering portions of said plurality of traffic lanes and upon each said detection incident of one or more vehicles in said leaving portions of said plurality of traffic lanes generate one or more block signals corresponding to said leaving portions of said plurality of traffic lanes;

a plurality of traffic signals corresponding to each of said entering portions of said plurality of traffic lanes; and at least one controller, wherein said at least one controller is configured to accept each of said one or more demand and block signals and control each of said plurality of traffic signals to permit movement of said vehicles through each of said one or more intersections.

2. The system of claim 1, wherein said plurality of detectors includes an optical camera system adapted to monitor the section of the entering portion located outside of the immediate vicinity of the corresponding intersection.

3. A method for controlling movement of vehicles at one or more intersections, wherein each of said one or more intersections includes a plurality of traffic lanes and a plurality of traffic signals, wherein each of said plurality of traffic lanes includes an entering portion, a leaving portion, a stop line located between each of said one or more intersections and each of said entering portions for each of said plurality of traffic lanes, and wherein each of said plurality of traffic signals corresponds to one or more of said plurality of traffic lanes, comprising:

setting each of said plurality of traffic signals to a stop indication;

monitoring one or more of said entering portions of said plurality of traffic lanes to detect presence of a vehicle within one of said entering portions of said plurality of traffic lanes;

generating a demand signal in response to detecting said presence of said vehicle, the demand signal corresponding to said traffic lane in which said vehicle was detected approaching said one or more intersections during said monitoring of one or more of said entering portions; and setting at least one of said plurality of traffic signals corresponding to said traffic lane for which said demand signal was generated to a proceed indication in response to the demand signal when said vehicle is at least a selected distance from said at least one of said plurality of traffic signals such that said vehicle is not required to come to a stop before proceeding through said intersection.

4. The method of claim 3 wherein said step of setting at least one of said plurality of traffic signals to a proceed indication occurs before said vehicle reaches a location in the vicinity of the stop line.

5. A method for controlling movement of vehicles at one or more intersections, wherein each of said one or more intersections includes a plurality of traffic lanes and a plurality of traffic signals, wherein each of said plurality of traffic lanes includes an entering portion, a leaving portion, a stop line located between each of said one or more intersections and each of said entering portions for each of said plurality of traffic lanes, and wherein each of said plurality of traffic signals corresponds to one or more of said plurality of traffic lanes, comprising:

setting each of said plurality of traffic signals to a stop indication;

monitoring one or more of said entering portions of said plurality of traffic lanes to detect presence of one or more vehicles within one or more of said entering portions of said plurality of traffic lanes;

generating a demand signal corresponding to said plurality of traffic lanes in which said one or more vehicles was detected approaching said one or more intersections during said monitoring of one or more of said entering portions;

monitoring one or more of said leaving portions of said plurality of traffic lanes to detect presence of one or more vehicles within one or more of said leaving portions of said plurality of traffic lanes;

generating a block signal corresponding to said plurality of traffic lanes in which said one or more vehicles was detected leaving said one or more intersections during said monitoring of one or more of said leaving portions;

determining that the leaving portion of at least one of said plurality of traffic lanes for which said block signal was not generated is unblocked;

setting at least one of said plurality of traffic signals corresponding to at least one of said plurality of traffic lanes for which said demand signal was generated and said block signal was not generated to a proceed indication; and setting each of said plurality of traffic signals to a stop indication if said demand signal is not present.

6. The method of claim 5 further comprising:

determining that a conflicting demand signal is present, wherein said conflicting demand signal corresponds to one of said plurality of traffic lanes that conflicts with said at least one of said plurality of traffic lanes corresponding to said at least one of said plurality of traffic signals with said proceed indication;

measuring a time period over which the conflicting demand is present;

determining that the leaving portion of said one of said plurality of traffic lanes corresponding to said conflicting demand signal is unblocked; and setting each of said plurality of traffic signals corresponding to each of said plurality of traffic lanes that conflict with said one of said plurality of traffic lanes corresponding to said conflicting demand signal to a halt indication and setting each of said plurality of traffic signals corresponding to said one of said plurality of traffic lanes corresponding to said conflicting demand signal to a proceed indication upon determining that said measured time period exceeds a predetermined period of time.

7. The method of claim 5 further comprising:

determining that one or more non-conflicting demand signals have been generated, wherein said one or more non-conflicting demand signals correspond to one or more of said plurality of traffic lanes that do not conflict with said plurality of traffic lanes corresponding to said plurality of traffic signals with said proceed indication;

determining that a minimum predetermined amount of time exists before any conflicting demand will be serviced; and setting each of said plurality of traffic signals corresponding to each of said plurality of traffic lanes corresponding to said one or more non-conflicting demand signals for which a corresponding block signal is not present to a proceed indication while said at least one of said plurality of traffic signals displays the proceed indication.

8. A method for controlling movement of vehicles at one or more intersections, wherein each of said one or more intersections includes a plurality of traffic lanes and a plurality of traffic signals, wherein each of said plurality of traffic lanes includes an entering portion, a leaving portion, a stop line located between each of said one or more intersections and each of said entering portions for each of said plurality of traffic lanes, and wherein each of said plurality of traffic signals corresponds to one or more of said plurality of traffic lanes, comprising:

setting each of said plurality of traffic signals to a stop indication;

monitoring one or more of said entering portions of said plurality of traffic lanes to detect presence of one or more vehicles within one or more of said entering portions of said plurality of traffic lanes;

generating a demand signal corresponding to said plurality of traffic lanes in which said one or more vehicles was detected approaching said one or more intersections during said monitoring of one or more of said entering portions;

monitoring one or more of said leaving portions of said plurality of traffic lanes to detect presence of one or more vehicles within one or more of said leaving portions of said plurality of traffic lanes;

generating a block signal corresponding to said plurality of traffic lanes in which said one or more vehicles was detected leaving said one or more intersections during said monitoring of one or more of said leaving portions;

setting at least one of said plurality of traffic signals corresponding to at least one of said plurality of traffic lanes for which said demand signal was generated and said block signal was not generated to a proceed indication;

setting each of said plurality of traffic signals to a stop indication if said demand signal is not present;

determining if a conflicting demand signal is present, wherein said conflicting demand signal corresponds to one of said plurality of traffic lanes that conflicts with said at least one of said plurality of traffic lanes corresponding to said at least one of said plurality of traffic signals with said proceed indication;

setting each of said plurality of traffic signals corresponding to each of said plurality of traffic lanes that conflict with said one of said plurality of traffic lanes corresponding to said conflicting demand signal to a halt indication and setting each of said plurality of traffic signals corresponding to said one of said plurality of traffic lanes corresponding to said conflicting demand signal to a proceed indication if said conflicting demand signal is present and if said conflicting demand signal has been present for a predetermined period of time and if a block signal corresponding to said one of said plurality of traffic lanes corresponding to said conflicting demand signal is not present;

determining if a vehicle corresponding to said conflicting demand signal is traveling at a rate of speed such that it is capable of stopping before reaching said stop line corresponding to said traffic lane in which said vehicle is traveling; and setting each of said plurality of traffic signals to a stop indication if it is determined that said vehicle is not capable of stopping before reaching said stop line.

9. A system for controlling movement of vehicles at an intersection, the intersection comprising a section of a traffic lane, the traffic lane comprising an entering portion and a leaving portion, the system comprising:

a first detector for monitoring the entering portion and generating a demand signal upon detecting a vehicle within the entering portion;

a second detector for monitoring the leaving portion and generating a block signal upon detecting a vehicle within the leaving portion;

a traffic indicator for directing movement of vehicles through the intersection, the traffic indicator being adapted to display indications observable by traffic in the traffic lane during use, the indications comprising a proceed indication and a halt indication;

a controller for controlling the traffic indicator, the controller being adapted to receive a signal from at least one of the detectors and set the traffic indicator as a function of the signal, the controller being adapted to set the traffic indicator to a proceed indication receiving the demand signal, the controller being adapted to cause the traffic indicator to display the halt indication in response to receiving the block signal.

10. The system of claim 9 wherein the leaving portion is adjacent to the intersection.

11. The system of claim 9 wherein the block signal is adapted to override the demand signal whereby the controller is adapted to cause the traffic indicator to display the halt indication upon receiving the demand signal from the first detector and the block signal from the second detector.

12. The system of claim 9 wherein at least a portion of the entering portion is a sufficient distance from the intersection such that the first detector can detect a vehicle moving toward the intersection and send a demand signal to the controller to cause the traffic indicator to change a halt indication to a proceed indication before the vehicle reaches the intersection so as to allow the vehicle to proceed through the intersection without first coming to a stop.

13. The system of claim 9, further comprising an optical camera system adapted to detect the presence of vehicles within the leaving portion.

14. A system for controlling movement of vehicles at an intersection, the intersection comprising a section of a traffic lane, the traffic lane comprising an entering portion and a leaving portion, the system comprising:

a first detector for monitoring the entering portion and generating a demand signal upon detecting a vehicle within the entering portion;

a second detector for monitoring the leaving portion and generating a block signal upon detecting a vehicle within the leaving portion;

a traffic indicator for directing movement of vehicles through the intersection, the traffic indicator being adapted to display indications observable by traffic in the traffic lane during use, the indications comprising a proceed indication and a halt indication;

a controller for controlling the traffic indicator, the controller being adapted to receive a signal from at least one of the detectors and set the traffic indicator as a function of the signal, the controller being adapted to set the traffic indicator to a proceed indication upon receiving the demand signal, the controller being adapted to cause the traffic indicator to display the halt indication upon receiving the block signal; and a plurality of traffic lanes and a plurality of traffic indicators, each of the plurality of traffic indicators being adapted to display the indications for a corresponding traffic lane of the plurality of traffic lanes, and wherein the controller is adapted to determine whether a vehicle detected in the entering portion is traveling at a rate of speed such that it is capable of stopping before reaching the intersection, and wherein each of the traffic indicators displays the halt indication for its corresponding traffic lane when the first detector determines that the vehicle is not capable of stopping before reaching the intersection.

15. A system for preventing vehicle accidents at an intersection, the intersection comprising a plurality of sections of traffic lanes, each of the traffic lanes comprising an entering portion and a stop line, the system comprising:

a detector for monitoring the entering portion, the detector being adapted to (a) detect a vehicle within the entering portion during use, (b) determine if the vehicle is traveling at a rate of speed such that it is capable of stopping before reaching the intersection during use, and (c) generate a signal upon determining that the vehicle is not capable of stopping before reaching the stop line;

traffic indicators for directing movement of vehicles through the intersection, each of the traffic indicators being adapted to display a plurality of indications for a corresponding traffic lane during use, the indications comprising a halt indication; and a controller for controlling the traffic indicators, the controller being adapted to receive the signal from the detector and, in response to the signal, cause all of the traffic indicators to simultaneously display the halt indication during use.

16. A method for controlling movement of vehicles at an intersection, the intersection comprising a section of a traffic lane, the traffic lane comprising an entering portion and a leaving portion, the method comprising:

monitoring the entering portion of the traffic lane to determine if a vehicle is within the entering portion;

monitoring the leaving portion of the traffic lane to determine if a vehicle is within the leaving portion;

determining that the leaving portion is unblocked;

generating a demand signal upon detecting a vehicle within the entering portion; and displaying a proceed indication in response to the demand signal, the proceed indication being displayed from a traffic indicator and being observable from the traffic lane.

17. The method of claim 16, further comprising detecting a vehicle within the leaving portion;

generating a block signal upon detecting the vehicle within the leaving portion;

preventing the traffic indicator, in response to the generated block signal, from displaying a proceed indication for the traffic lane; and causing the traffic indicator to display a proceed indication upon determining that the leaving portion is unblocked.

18. The method of claim 16 wherein the step of monitoring the leaving portion further comprises determining that the leaving portion is blocked, and further comprising preventing the proceed indication from being displayed while the leaving portion is blocked.

19. The method of claim 16, further comprising:

measuring a time period elapsed during the display of the proceed indication;

monitoring an entering portion of a non-conflicting lane that does not conflict with the section of traffic lane;

generating a non-conflicting demand signal upon detecting a vehicle within the entering portion of the non-conflicting lane; and displaying a non-conflicting proceed indication that is observable from the non-conflicting lane upon determining that the measured time period does not exceed a predetermined value;

and wherein the proceed indication and the non-conflicting proceed indication are simultaneously displayed.

20. The method of claim 19, further comprising monitoring a leaving portion of the non-conflicting lane and displaying the non-conflicting proceed indication upon determining that the leaving portion is unblocked.

21. The method of claim 16, further comprising generating a block signal when a vehicle is detected within the leaving portion, the block signal causing the traffic indicator to display a halt indication for the traffic lane to prevent traffic not capable of proceeding completely through the intersection from entering the intersection.

22. A method for controlling movement of vehicles at an intersection, the intersection comprising a section of traffic lane, the traffic lane comprising an entering portion and a leaving portion, the method comprising:

monitoring the entering portion of the traffic lane to determine if vehicle is within the entering portion;

monitoring the leaving portion of the traffic lane to determine if a vehicle is within the leaving portion;

generating a demand signal upon detecting a vehicle within the entering portion; and displaying a proceed indication in response to the demand signal, the proceed indication being displayed from a traffic indicator and being observable from the traffic lane; and determining if the vehicle within the entering portion is traveling at a rate of speed such that it is capable of stopping before it reaches the intersection, and further comprising displaying a halt indication on the traffic indicator for the traffic lane and displaying a halt indication on an additional traffic indicator corresponding to a conflicting traffic lane upon determining that the vehicle is not capable of stopping before it reaches the intersection.

* * * * *

UNITED STATES PATENT AND TRADEMARK OFFICE

CERTIFICATE OF CORRECTION

PATENT NO. : 5,777,564

DATED : July 7, 1998

INVENTOR(S) : Edward L. Jones

It is certified that error appears in the above-identified patent and that said Letters Patent is hereby corrected as shown below:

Claim 1, col. 7, line 13, please delete "stop the" and substitute "stop line".

Signed and Sealed this

Seventeenth Day of November, 1998

Bruce Lehman

*Attest:*

BRUCE LEHMAN

*Attesting Officer*

*Commissioner of Patents and Trademarks*